US011692467B2

(12) United States Patent
Tullis et al.

(10) Patent No.: US 11,692,467 B2
(45) Date of Patent: Jul. 4, 2023

(54) OIL PAN ASSEMBLY INCLUDING LAMINATE AND CLINCH NUT

(71) Applicant: MATERIAL SCIENCES CORPORATION, Canton, MI (US)

(72) Inventors: Bryan Joseph Tullis, Commerce Township, MI (US); Jason Schoonover, Milan, MI (US)

(73) Assignee: MATERIAL SCIENCES CORPORATION, Canton, MI (US)

( * ) Notice: Subject to any disclaimer, the term of this patent is extended or adjusted under 35 U.S.C. 154(b) by 720 days.

(21) Appl. No.: 16/494,390

(22) PCT Filed: Jul. 10, 2018

(86) PCT No.: PCT/US2018/041390
§ 371 (c)(1),
(2) Date: Sep. 16, 2019

(87) PCT Pub. No.: WO2019/014179
PCT Pub. Date: Jan. 17, 2019

(65) Prior Publication Data

US 2020/0131958 A1 Apr. 30, 2020

Related U.S. Application Data

(60) Provisional application No. 62/569,223, filed on Oct. 6, 2017, provisional application No. 62/559,123, filed
(Continued)

(30) Foreign Application Priority Data

Dec. 13, 2017 (CN) ..... 201711328996.9

(51) Int. Cl.
*B65D 1/34* (2006.01)
*F01M 11/00* (2006.01)
*F01M 11/04* (2006.01)

(52) U.S. Cl.
CPC ..... *F01M 11/0004* (2013.01); *F01M 11/0408* (2013.01); *F01M 2011/0012* (2013.01); *F01M 2011/0416* (2013.01)

(58) Field of Classification Search
CPC ..... B32B 15/20; B32B 2255/06; B32B 15/08; B32B 15/18; F01M 11/0004
(Continued)

(56) References Cited

U.S. PATENT DOCUMENTS 4,193,435 A * 3/1980 Frosch ..... F16B 37/044 411/113
4,223,073 A * 9/1980 Caldwell ..... B32B 15/18 165/84
(Continued)

FOREIGN PATENT DOCUMENTS

JP S60-92749 U 6/1985
WO 2016/178651 A1 11/2016

OTHER PUBLICATIONS

International Search Report and Written Opinion, Application No. PCT/2018/041390 dated Oct. 10, 2018.
(Continued)

*Primary Examiner* — Long T Tran
*Assistant Examiner* — James J Kim
(74) *Attorney, Agent, or Firm* — The Dobrusin Law Firm, P.C.

(57) ABSTRACT

The teachings herein are related to assemblies, such as oil pan assemblies, including a laminate bottom portion and a nut attached to the laminate bottom portion. The nut may provide a sealable opening to a cavity of the assembly. The laminate bottom portion preferably includes a polymeric layer sandwiched between two metallic layers. The nut preferably is a clinch nut.

20 Claims, 11 Drawing Sheets

Related U.S. Application Data on Sep. 15, 2017, provisional application No. 62/531,070, filed on Jul. 11, 2017.

(58) Field of Classification Search
USPC ..... 220/571
See application file for complete search history.

(56) References Cited

U.S. PATENT DOCUMENTS 5,251,370 A * 10/1993 Muller ..... F16B 37/062 29/520
7,357,225 B2 * 4/2008 Dorian ..... F01M 11/0408 184/105.3
7,919,174 B2 * 4/2011 Ruokolainen ..... B32B 15/08 181/290
8,109,704 B2 2/2012 Lewis et al.
8,210,315 B2 7/2012 Diehl et al.
8,418,812 B1 * 4/2013 Rosen ..... F01M 11/04 411/371.1
8,517,651 B2 * 8/2013 Babej ..... B21K 1/702 411/179
2004/0042871 A1 * 3/2004 Wojciechowski .... F16B 33/004 411/181
2004/0086355 A1 * 5/2004 Couillais ..... F16B 37/068 411/181
2005/0188636 A1 * 9/2005 Burns ..... F16B 37/00 52/295
2006/0062977 A1 * 3/2006 Sigler ..... B32B 5/16 428/209
2008/0098979 A1 5/2008 Vincer et al.
2008/0260489 A1 10/2008 Brown et al.
2011/0194913 A1 * 8/2011 Lewis ..... F16B 37/044 411/432
2012/0171413 A1 7/2012 Fisk et al.
2012/0318799 A1 * 12/2012 Spix ..... F01M 11/0408 220/288

OTHER PUBLICATIONS

International Preliminary Report on Patentability, Application No. PCT/2018/041390 dated Dec. 31, 2019.

* cited by examiner (1.6 mm twist out =15 samples)

(1.6 mm Push out = 15 samples)

OIL PAN ASSEMBLY INCLUDING LAMINATE AND CLINCH NUT

CLAIM OF PRIORITY

The present application claim priority to U.S. Provisional Patent Applications US 62/531,070 filed on Jul. 11, 2017, 62/559,123 filed on Sep. 15, 2017, and 62/569,223 filed on Oct. 6, 2017, and to Chinese Patent Application 2017113289969 filed on Dec. 13, 2017; the contents of which are each incorporated herein by reference.

FIELD

The teachings herein are related to assemblies, and more specifically to container assemblies, such as oil pan assemblies, including a laminate bottom portion and a nut attached to the laminate bottom portion. The nut may provide a sealable opening to a cavity of the assembly. The laminate bottom portion preferably includes a polymeric layer sandwiched between two metallic layers. The nut preferably is a clinch nut.

BACKGROUND

Drain plugs are provided in a variety of assemblies for draining a fluid from a container and then closing the drain. This is often accomplished by welding a nut to a bottom portion of the container. When, the container is formed from a steel, typically a steel nut is spot welded to the container. When the container includes a monolithic aluminum container (e.g., formed from aluminum sheet), a nut typically is projection welded onto the container. As another example, the assembly may include an aluminum bottom portion where the aluminum bottom portion is machined from cast aluminum to provide a threaded opening for receiving a drain plug. When the assembly includes a steel laminate (including a thin polymeric layer between two steel layers), a nut can also be projection welded to the steel layers.

Cast aluminum typically has porosity, pores or inclusions which result in local areas of weakness. Such a material may result in failure in an oil pan assembly particularly if one of the weak areas is at or near a drain. Furthermore, cast aluminum with a machined threaded opening may be susceptible to stripping of threadings due to the relatively soft nature of aluminum (e.g., relative to steel).

Examples of assemblies including a closable drain include those described in U.S. Pat. No. 8,210,315 B2 (issued on Jul. 3, 2012 to Diehl et al.); U.S. Pat. No. 8,109,704 (issued on Feb. 7, 2012 to Lewis et al.); and US Patent Application Publication 2012/0318799 A1 (published on Dec. 20, 2012 by Spix et al.).

In U.S. Pat. No. 8,109,704 a two-piece cage nut assembly is employed for a drain. It appears that legs of the cage are welded (e.g., projection welded) to a bottom portion of an oil pan. U.S. Pat. No. 8,109,704 teaches that the need for drainage channels near the bottom of the cage nut assembly. The only sealing in U.S. Pat. No. 8,109,704 is by a seal in the area of the flange of the bolt. The nut extends considerably into the oil pan because the threading only begins after the channel. Such a nut can be described as having a high stove pipe. The draining of the oil pan will initially be fast due to flow through the main opening. However, this will change to a flow through only the channel when the level drops below the top of the nut. This prolonged slow flow may result in a service person incorrectly thinking that the draining is completed. Additionally, if the channel becomes blocked drainage below the top of the nut may be prevented. In these circumstances, there may be insufficient drainage of the oil. This is a complex design and requires that the seal between the bolt flange and a bottom surface of the oil pan be a primary seal.

However, these methods are not usually compatible with laminate materials having aluminum layers. For example, when a laminate includes a polymeric layer between two aluminum layers, it may be difficult to projection weld a nut, and a relatively thin aluminum layer may fail from applied torques (e.g., during removing or inserting a drain plug). For example, a projection weld on an aluminum laminate material typically results in engagement with only a single layer of aluminum, causing weakness due to the relatively thin layer of aluminum (relative to the total thickness of the aluminum laminate material). Furthermore, the aluminum layers may be too thin to allow for machining to provide a threaded opening.

There is a need for an oil pan assemblies having one or any combination of the following features: drain attachment that are simple in design and/or simple in assembly; an assembly that includes both a primary seal and a secondary seal, an assembly with a short stove pipe so that nearly complete drainage may be completed, a single drainage mechanism (e.g., so that discontinuity in the drainage rate is avoided), drain attachment having good push through resistance, drain attachment having good torque resistance, drain attachment having good twist resistance, low or improved NVH properties (i.e., low or reduced noise, low or reduced vibration, low or reduced harshness, or any combination thereof), and light weight.

SUMMARY OF THE INVENTION

One or more of the aforementioned needs may be met with a container assembly (e.g., an oil pan assembly) according to the teachings herein.

One aspect of the teachings herein is directed at a container assembly (e.g., an oil pan assembly) comprising: a container having a cavity for holding a fluid and including a bottom portion, wherein the bottom portion includes a laminate material including a first aluminum layer having a surface facing the cavity of the container, a second aluminum layer having a surface facing an outside of the container, and a polymeric layer interposed between the first and second metal layers; an opening in the bottom portion extending through the first and second aluminum layers for draining the fluid from the container; and a clinch nut attached to at least the first aluminum layer and position for receiving a drain plug that seals the opening and provides a primary seal to prevent flow of the fluid. The first aluminum layer may be an interior layer of the container. For example, an interior surface of the container may include the first aluminum layer. The second aluminum layer may be an exterior layer of the container. For example, an exterior surface of the container may include the second aluminum layer. The polymeric layer preferably contacts or is directly attached to the first aluminum layer, the second aluminum layer, or both. The bottom portion of the container preferably is formed of the laminate material. The entire container preferably is formed of the laminate material.

This aspect of the teachings may be further characterized by one or any combination of the following features: the attachment between the clinch nut and the first aluminum layer forms a seal around an entire circumference of the opening; the clinch nut is attached to both the first and second aluminum layers; a ratio of a thickness of the first aluminum layer to a thickness of the second aluminum later is about 0.33 or more (e.g., about 0.5 or more, about 0.7 or more, about 0.9 or more, or about 1.0 or more); a ratio of the thickness of the first aluminum later to the thickness of the second aluminum layer is about 3 or less (e.g., about 2 or less, about 1.4 or less, or about 1.1 or less); the polymeric layer has a thickness of about 0.2 mm or less, preferably about 0.1 mm or less, more preferably about 0.5 mm or less, and most preferably about 0.03 mm or less; the polymeric layer has a thickness of about 0.001 mm or more (for example, about 0.003 mm or more, about 0.01 mm or more, or about 0.02 mm or more); the polymeric layer has a thickness that is about 15% or less (preferably about 10% or less, even more preferably about 5% or less, and most preferably about 2% or less) of a total thickness of the laminate material; the first and second aluminum layers have a combined thickness of about 0.5 mm or more (e.g., about 0.7 mm or more, about 0.9 mm or more, or about 1.1 mm or more); the combined thickness of the first and second aluminum layers is about 4 mm or less (e.g., about 3 mm or less, about 2.5 mm or less, or about 2 mm or less); the clinch nut is an aluminum clinch nut; the clinch nut is a steel that is coated; the clinch nut includes a steel; the clinch nut has a passage with internal threading and includes 3 or more turns of the threading (preferably 4 or more turns; preferably the number of turns is about 7 or less, more preferably about 6 or less and most preferably about 5 or less); the clinch nut includes a first portion (i.e., a stove pipe portion) that extends into the cavity of the container; the clinch nut does not extend below the bottom surface of the container; the stove pipe portion preferably has a length of about 15 mm or less (more preferably about 12 mm or less, even more preferably about 10 mm or less, and most preferably about 9 mm or less); the first portion of the clinch nut has a height that is sufficiently short so that an amount of fluid remaining in the cavity after a draining of the cavity is reduced or minimized; the first portion has a height of about 15 mm or less (preferably about 10 mm or less, and more preferably about 5 mm or less) as measured in a vertical direction from a top surface of the laminate to a top edge of the first portion (i.e., the distance by which the clinch nut protrudes into the cavity of the container); the a container assembly (e.g., oil pan assembly) includes a drain plug for sealing the opening; the drain plug has a threaded shaft for affecting a primary seal; the drain plug forms a secondary seal entirely outside of the affected area of the clinch nut; the secondary seal is obtained by an elastomeric ring (i.e., an elastomeric washer) that contacts the aluminum outer surface of the container only at a flat area; the drain plug includes a threaded shaft for screwing into the clinch nut; the drain plug includes a head portion configured for receiving a tightening tool (for example for torqueing the drain plug to a pre-determined torque); the drain plug includes an elastomeric washer in contact with a flange portion of the drain plug and positioned so that the flange portion applies a force to the elastomeric washer for forming a seal between the flange portion and an outside surface of the bottom of the container; the flange portion has a diameter of about 10 mm or more (preferably about 15 mm or more, and more preferably about 20 mm or more); a ratio of a diameter of the elastomeric washer to a diameter of the shaft of the drain plug is about 2 or more (or about 2.5 or more); a ratio of a diameter of the flange of the drain plug to a diameter of the shaft of the drain plug is about 2 or more (or about 2.5 or more); the container assembly (e.g., the oil pan assembly) has a weight that is less than the weight of a similar sized oil pan assembly where the container is formed of steel; the container assembly (e.g., the oil pan assembly) has one or more improved noise, vibration, or harshness (i.e., NVH) properties compared to a similar sized container assembly where the container is formed of steel or cast aluminum; the container assembly (e.g., the oil pan assembly) has a durability (e.g., torque resistance, pull-out resistance, twist-off resistance, or any combination thereof) that is at least as good as the durability of a similar sized container assembly where the container is formed of cast aluminum; the clinch nut includes a coated steel (e.g., a zinc coated steel); the container assembly (e.g., the oil pan assembly) includes a coated steel drain plug (e.g., a zinc coated steel); or the shaft of the drain plug and/or the stove pipe of the clinch nut is formed of a mixed metal.

Another aspect according to the teachings herein is directed at a method of forming a container assembly (e.g., an oil pan assembling) comprising the steps of attaching a clinch nut to a container (e.g., an oil pan container) formed of a laminate material including a polymeric layer interposed between two aluminum layers, wherein the clinch nut directly attaches to both of the aluminum layers.

The oil pan assemblies according to the teachings herein preferably have improved NVH properties. The oil pan assemblies according to the teachings herein, preferably are durable (e.g., as characterized by push-out resistance, twist-out resistance, torque resistance, or any combination thereof).

BRIEF DESCRIPTION OF THE DRAWINGS

FIG. 8 shows illustrative relationship between the features of the region of the opening relative to the seal.

DETAILED DESCRIPTION

The container assembly (e.g., the oil pan assembly) includes a container having a cavity for containing a liquid, such as oil, and a drain component attached to the container for removing liquid (e.g., oil) from the cavity. The container preferably includes a composite material having a polymeric layer for improving one or more NVH properties. The drain component preferably includes or consists essentially of a clinch nut. The drain component may be sealed by one or more seals, and preferably is sealed using both a primary seal and secondary seal. The drain of the oil preferably occurs through the opening of the clinch nut. The container assembly (e.g., the oil pan assembly) may also include a sealing component (e.g., a drain plug) for reversibly sealing the drain component.

Container

The container assembly (e.g., the oil pan assembly) includes a container (e.g., an oil pan) having a cavity for holding a volume of oil. The container may have one or more openings for circulating the oil to a mechanical component for controlling the temperature of the mechanical component. It may be necessary to periodically drain the oil from the container. As such the container typically has one or more openings for draining the oil.

The container may be any size and shape. The container has one or more walls having an interior surface suitable for contact with the fluid in the container (e.g., at elevated temperatures). The walls of the container have an exterior surface. The exterior surface may be an exposed surface (e.g., exposed to air). The opening for draining the oil is preferably at or near a bottom portion of the container. Some or all of the walls of the container includes or is formed of a composite material. Preferably the bottom portion of the container includes the composite material.

Composite Material/Laminate Material

The container (e.g., the oil pan) preferably includes or is formed of a composite material including a polymeric layer for improving one or more NVH properties. More preferably, the walls of the oil pan are formed of a composite material including a polymeric layer. The composite material includes, consists essentially of, or consists entirely of a laminate material including a polymeric layer interposed between two metallic layers. The metallic layer preferably includes a generally light weight metal or metal alloy. For example, the density of the material of the metallic layer may be less than the density of steel. Preferably the density of the metal or metal alloy of the metallic layer is about 6 $g/cm^3$ or less, more preferably about 4.4 $g/cm^3$ or less, even more preferably about 3.6 $g/cm^3$ or less, and most preferably about 2.9 g/cm3 or less. Preferably, the metallic layer includes or consists essentially of aluminum or an aluminum alloy (e.g., including about 50 weight percent or more aluminum atoms, based on the total weight of the aluminum alloy).

Figure 1:
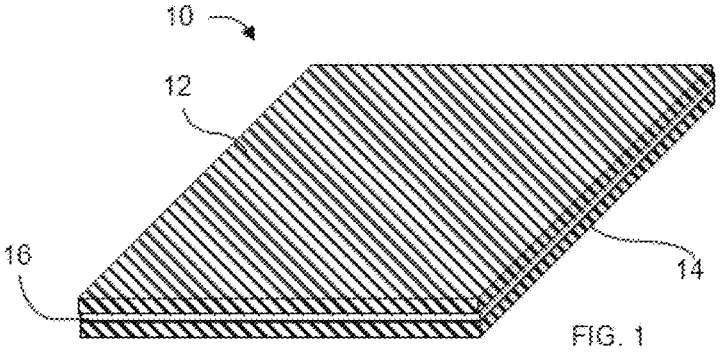
FIG. 1 is a perspective view of a composite material that is a laminate material include a polymeric layer interposed between two metallic layers.

The composite material 10 may be a laminate material including a first metallic layer 12, a second metallic layer 14, and a polymeric layer interposed between the first and second metallic layers, such as illustrated in FIG. 1.

Preferably the laminate material is an aluminum composite material. As used herein, an aluminum composite material includes two metallic layers, wherein at least one metallic layer (and preferably both metallic layers) is an aluminum layer. The aluminum layer may consist essentially of aluminum or may be an aluminum alloy having about 50 weight percent or more (preferably about 80 weight percent or more) aluminum atoms, based on the total weight of the alloy. The aluminum may be selected for heat treatability, drawability, or both. Preferred aluminums include soft aluminum and have a high drawability. Examples of particularly useful aluminum grades are 5000 series and 6000 series, such as 5754 and 5182 grades of aluminum layers. In forming the composite material, a surface of the aluminum may be cleaned and/or passivated.

A wall of the container (e.g., the oil pan) may be formed from a sheet of the composite material (e.g., from the aluminum composite material). Preferably the sheet of the composite material has a uniform thickness (e.g., before forming). Preferably the average wall thickness of the oil pan is within about 20% (more preferably within about 10%) of the original thickness of the sheet before forming into the wall.

The total thickness of the composite material and/or the average wall thickness of the container (e.g., the oil pan) preferably is about 0.5 mm or more, more preferably about 0.7 mm or more, even more preferably about 0.9 mm or more, and most preferably about 1.1 mm or more. If the thickness is too small, the oil pan may be damaged during use, such as during plugging of the drain. The total thickness of the composite material and/or the average wall thickness of the container (e.g., the oil pan) preferably is about 4 mm or less, more preferably about 3 mm or less, even more preferably about 2.5 mm or less, and most preferably about 2 mm or less. If the thickness is too high, the cost and or weight of the container may be too high.

The first and second metallic layers may have a thickness that is the same or that is different. The ratio of the first metallic layer (e.g., aluminum or aluminum alloy layer) to the second metallic layer preferably is about 0.33 or more, about 0.5 or more, about 0.7 or more, about 0.9 or more, or about 1.0 or more. The ratio of the first metallic layer to the second metallic layer preferably is about 3 or less, about 2 or less, about 1.4 or less, or about 1.1 or less. Each of the metallic layers should be sufficiently thick so that the layer does not easily tear and/or so that the layer can provides significantly to the strength of the structure.

The thickness of the polymeric layer preferably is sufficiently low so that any reduction in the stiffness of the composite material (e.g., relative to the materials of the metallic layers) at a temperature of about 25° C. is about 40% or less (preferably about 30% or less, more preferably is about 20% or less, and most preferably is about 10% or less). The stiffness may be characterized by the flexural modulus (e.g., as measured according to ASTM D790). Preferably, the thickness of the polymeric layer is about 0.2 mm or less, more preferably about 0.1 mm or less, even more preferably about 0.5 mm or less, and most preferably about 0.03 mm or less. The polymeric layer may have a thickness of about 0.001 mm or more, about 0.003 mm or more, about 0.010 mm or more, or about 0.02 mm or more.

The ratio of the thickness of the polymeric layer to the total thickness of the composite material preferably is about 0.20 or less, more preferably about 0.15 or less, even more preferably about 0.10 or less, even more preferably about 0.05 or less, and most preferably about 0.02 or less.

The container may include one or more reinforcing features, such as a rib that increase the stiffness of the container. This may be particularly important when using an aluminum laminate material where the polymeric core layer softens at elevated operating temperatures of an oil pan.

Materials for the Polymeric Layer

The polymeric layer may include, consist essentially of, or consist entirely of one or more polymers. Preferably, the amount of the polymer in the polymeric layer is about 50, more preferably about 80 weight percent or more, and most preferably about 90 weight percent, based on the total weight of the polymeric layer. The polymeric layer preferably includes one or more polymers having a low hardness. As used herein, polymer having a low hardness may be characterized by a Shore A durometer (measured according to ASTM D2240) of about 90 Shore A or less, preferably about 75 Shore A or less, and more preferably about 65 Shore A or less). Preferably the polymeric layer includes a polymer having a hardness of about 10 Shore A or more (e.g., about 20 Shore A or more, or about 30 Shore A or more). The polymer may have a crystallinity (e.g., as measured by differential scanning calorimetry according to ASTM D3418) of about 60% or less, about 50% or less, about 40% or less, about 30% or less, about 20% or less, or about 10% or less. For example, the polymer may be a generally amorphous polymer having a crystallinity of about 5% or less or about 0%. The polymeric layer may include a filler at a concentration of 3 wt. % or more, or may be substantially free (i.e., a filler concentration of less than 3 weight percent, or about 1 weight percent or less) or may be entirely free of filler. The polymeric material preferably includes an elastomeric material. A particularly preferred elastomeric material is an acrylic elastomer. The polymeric material may be formed with a cross-linking agent, so that the polymeric material includes a cross-linked elastomer. The polymeric material may include a generally high molecular weight polymer (e.g., having a molecular weight of about 30,000 or more, about 80,000 or more, or about 200,000 or more). The polymeric material may be selected to provide adhesion to the aluminum and/or an adhesive or other bonding agent may be employed for improving the adhesion of the polymeric material to the aluminum.

Examples of composite materials that may be employed include structures including a viscoelastic material sandwiched between two sheets of aluminum, such as commercially available as QUIET ALUMINUM® brand composite material from MATERIAL SCIENCES CORPORATION.

Clinch Nut

The container assembly (e.g., the oil pan assembly) preferably includes a clinch nut attached to the composite material (e.g., the aluminum composite material) for providing a sealable drain for removing fluid from the container (e.g., the oil pan). The clinch nut may be attached to one or both of the metallic layers of the composite material. Preferably the clinch nut is attached to both of the metallic layers of the composite material.

The clinch nut should have an opening for draining fluid from the assembly. The opening of the clinch nut preferably forms a passage that extends a length of the clinch nut (e.g., from one end of the clinch nut to an opposing end of the clinch nut. The clinch nut may have a top rim at an entrance from the cavity into the passage. The clinch nut may have a bottom rim at an exit from the passage. The draining of the oil preferably occurs only through the passage of the clinch nut. For example, the clinch nut may be free of lateral openings, grooves, or other passages that extend through a wall of the clinch nut or between the clinch nut and the container. The opening of the clinch nut should be internally threaded for receiving a plug for closing the opening and stopping the flow of the fluid. The attachment between the clinch nut and the composite material preferably forms a seal around an entire circumference of the opening so that the fluid cannot leak from a space between the composite material and the clinch nut.

The clinch nut has a stove pipe portion that extends from an inner surface of the pan (e.g., the oil pan) into the cavity of the pan. The stove pipe portion should be sufficiently short so that substantially all of the fluid can be drained from the cavity of the pan.

The clinch nut should have a sufficient number of turns of the internal threading so that the drain plug can be securely attached. Preferably, the drain plug should be capable of being securely attached without damage to the internal threading of the opening (e.g., by stripping, or by overtorqueing). Preferably, the number of turns of threadings in the opening of the clinch nut is about 2 or more, more preferably about 3 or more, and most preferably about 4 or more.

The number of turns of the internal threading preferably is sufficiently small so that the length of the stove pipe of the clinch nut is generally small. Preferably the number of turns of threadings in the opening of the clinch nut is about 7 or less, more preferably about 6 or less, and even more preferably about 5 or less.

At least a portion of the turns of the internal threading preferably is located in the portion of the clinch nut that extends below the stove pipe portion (e.g., the portion between the external surface and the internal surface of the region of the pan adjacent to the clinch nut. Preferably, the number of turns of the internal threading located below the stove pipe portion is about 0.1 or more, more preferably about 0.3 or more, even more preferably about 0.4 or more, and most preferably about 0.5 or more.

When assembled, the clinch nut preferably does not extend below the outer surface of the oil pan (i.e., at the bottom of the oil pan). If a portion of the clinch nut extends below the outer surface of the oil pan, it preferably is sufficiently short so that it does not interfere with the sealing of the drain (e.g., using an elastomeric seal over a flange surface of the drain plug).

Figure 2A:
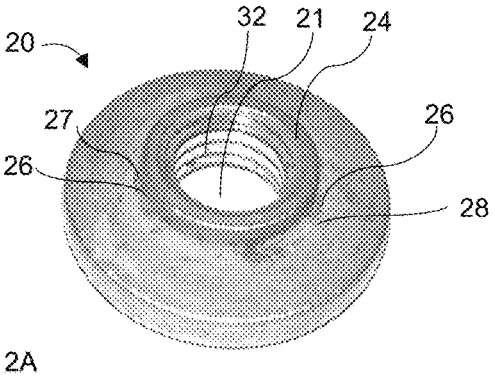
FIG. 2A is a perspective bottom view of an illustrative clinch nut.
Figure 2B:
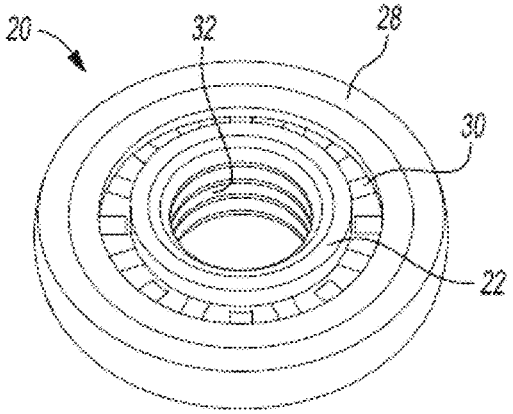
FIG. 2B is a perspective top view of an illustrative clinch nut.
Figure 2C:
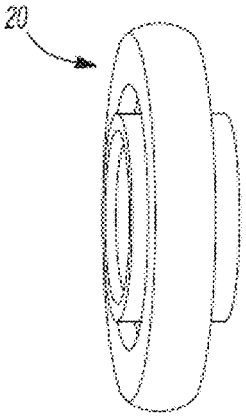
FIG. 2C is a side view of an illustrative clinch nut.
Figure 2D:
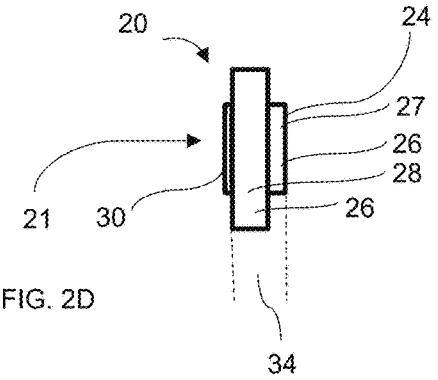
FIG. 2D is a schematic drawing of a side view of an illustrative clinch nut.
Figure 2E:
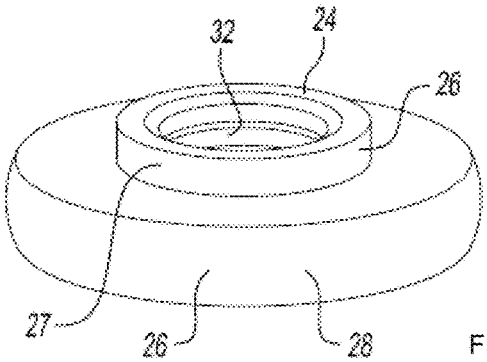
FIG. 2E is a photograph showing a perspective view (left image) and a bottom view (right image) of an illustrative clinch nut.
Figure 2E:
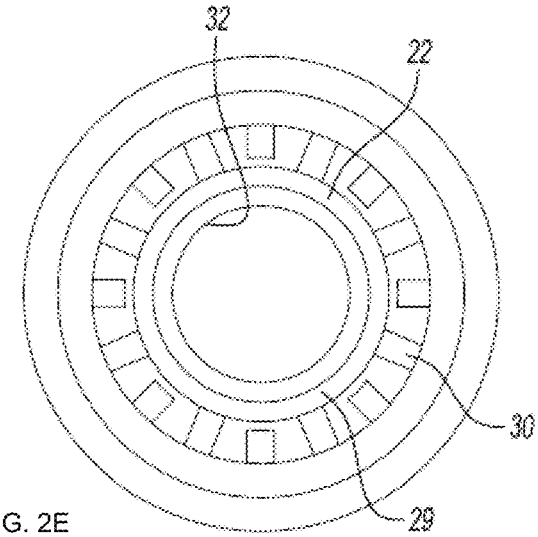

The clinch nut may have one or more of the features illustrated in FIGS. 2A, 2B, 2C, and 2E. The clinch nut 20 generally has a passage 21 for draining fluid from the oil pan assembly. The passage 21 preferably is at or near the axial center of the clinch nut. Preferably, the clinch nut has a single passage for the flow of the fluid. The passage 21 may be an internally threaded opening extending the height of the clinch nut 20 (i.e., from a bottom rim 22 of the opening 21 to an upper rim 24 of the opening. The height of the clinch nut after installation is the stove pipe height 34, such as shown in FIG. 2D. The stove pipe portion 26 of the clinch nut may provide a sufficient number of internal threadings 32 for closing the opening with a externally threaded plug. The clinch nut 20 may include a connector portion 30 for connecting the clinch nut to a wall of the container (e.g., to the composite material), preferably using heat and/or pressure. The stove pipe portion 26 may include a base region 28 near the bottom of the clinch nut 20 (i.e., towards the container). The stove pipe portion 26 may include a top region 27 near the top of the clinch nut (i.e., near the upper rim 24). With reference to FIGS. 2A, 2B, 2C, and 2E, the stove pipe height 34 may be sufficiently short so that the container may be substantially drained through the opening. The opening may be generally circular in shape for receiving a circular shaft of a plug. A wall around the opening may form a seal with the shaft of the plug to prevent flow of the fluid and/or to reduce the pressure of the fluid (e.g., at a secondary seal). The opening may include a channel, groove, or flange for receiving a seal or gasket (e.g., an elastomeric o-ring) for forming a tight seal between a wall of the opening and a shaft of the plug. The channel, groove or flange may be at any location along the opening, and preferably is near one of the ends, and more preferably near the bottom rim.

The connector portion of the clinch nut preferably forms a mechanical joint with the laminate or composite material. The mechanical joint preferably seals a circumference around the opening. This seal between the clinch nut and one or more face surfaces of the laminate or composite material preferably is a liquid-tight seal, and more preferably is a gas-tight seal. By forming a mechanical joint, it is possible to use different materials for a wall of the container (e.g., the laminate or composite material) and the clinch nut. The clinch nut may have an extension member 29. The extension member preferably extends in the direction of the bolt head. The extension member may be bent (e.g., in a radial direction) to apply a force on the laminate or composite material. When bent, the extension member may hold the laminate or composite material in place. The clinch nut may include anti-rotation features to prevent the clinch nut from rotating with respect to the laminate or composite material.

Container Assembly/Oil Pan Assembly

Figure 3:
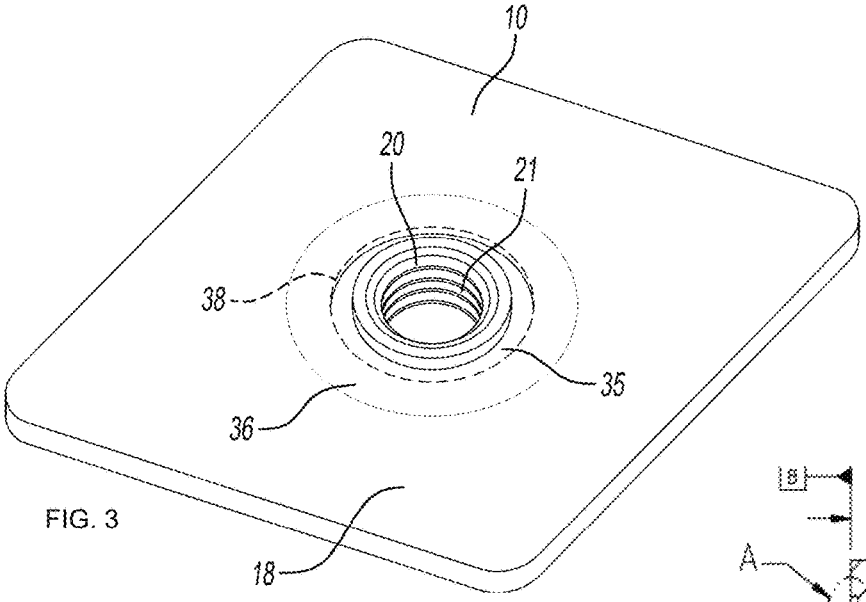
FIG. 3 is a bottom view of a portion of a container assembly (e.g., an oil pan assembly) including a clinch nut attached to a laminate material.

The container assembly (e.g., the oil pan assembly) may be formed by attaching the clinch nut to the laminate material. The region of the attachment may have one or more of the features illustrated in FIG. 3, showing a bottom view of a laminate material 10 attached to a clinch nut 20. For example, the attachment of the clinch nut 20 may result in an affected region 35 of the laminate material 10 that is generally not flat. This region may be unsuitable for forming a seal. Instead, a seal may be formed in a flat region 36 encircling the affected region 35. The clinch nut 20, preferably does not extend beyond the outer surface (e.g., the bottom surface) 18 of the laminate material 10.

The composite material preferably is stamped for forming the container (e.g., the container of the oil pan assembly). For example, a portion of the container may be formed by stamping one sheet of a composite material forming a stamped part. The stamped part may be sealingly connected to another portion of the container (preferably also formed by stamping the composite material). Preferably, the container is formed by sealingly connecting two or more stamped parts each formed of the composite material. The clinch nut is preferably attached to the stamped part after stamping and prior to sealingly connecting with another part.

Figure 4A:
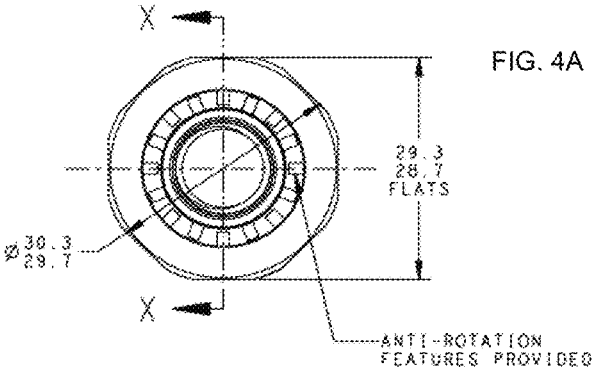
FIG. 4A is a bottom view of an illustrative clinch nut.
Figure 4B:
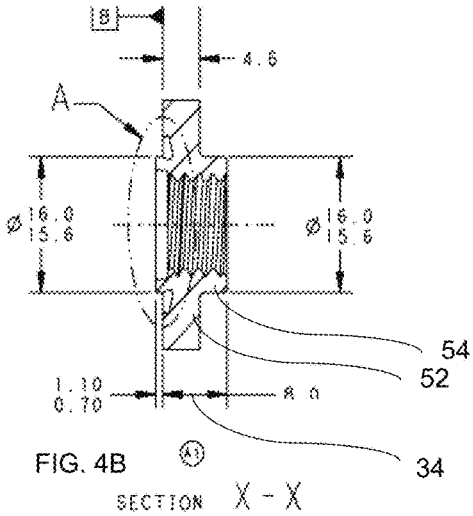
FIG. 4B and FIG. 4C are cross-sectional views of an illustrative clinch nut.
Figure 4C:
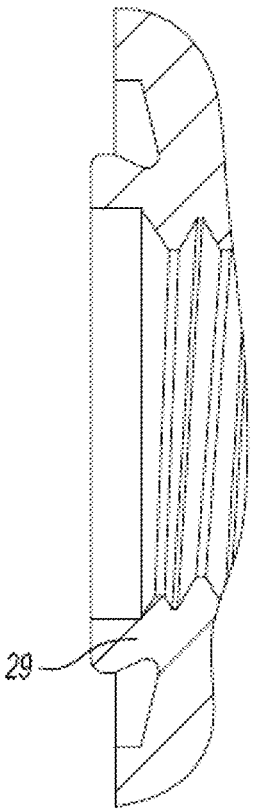

A bottom view of an illustrative clinch nut is shown in FIGS. 4A, 4B, and 4C. A clinch nut may include one or any combination of the features illustrated in FIGS. 4A, 4B, and 4C. The clinch nut may include an opening located at or near a central axis of the clinch nut. The opening may be internally threaded. Preferably the opening, extends from the bottom of the clinch nut to the top of the clinch nut and is the only passage for draining the container. For example, the side walls of the clinch nut may be solid, without any openings or channels. The clinch nut may have a first portion for connecting to the container and a second portion that extends into the container and provides additional internal threading for receiving a drain plug (e.g., a drain bolt). As illustrated in FIG. 4B, the first portion 52 may have a cross-section (e.g., a diameter) that is larger than the cross-section of the second portion 54. Preferably the ratio of the wall thickness of the first portion to the wall thickness of the second portion is about 1.5 or more, more preferably about 2.5 or more, and most preferably about 3.0 or more. The solid walls of the clinch nut (i.e., without any channels or openings) may allow the mating threaded surfaces of a drain plug shaft with the internally threaded opening of the clinch nut to form a primary seal. The primary seal may entirely prevent the flow of fluid and/or may reduce the pressure of the fluid (and particularly during the use of the container at elevated temperature and/or elevated pressure). For example, the pressure of the fluid inside the container near the top of the opening may have a first pressure and any fluid outside of the container near the bottom of the opening may have a second pressure, wherein the ratio of the second pressure to the first pressure is about 0.8 or less, about 0.5 or less, about 0.2 or less, about 0.1 or less, about 0.03 or less, or about 0.01 or less. The ratio of the second pressure to the first pressure may be about 0 or more.

Figure 5:
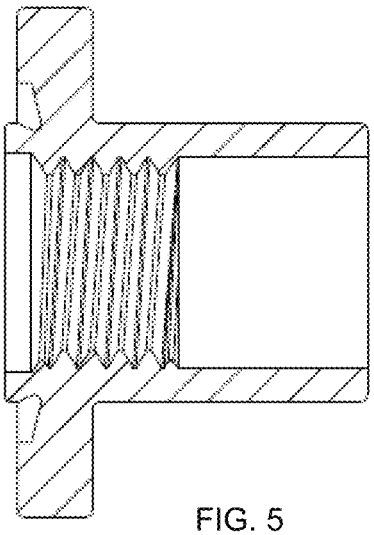
FIG. 5 is a cross-sectional view of a clinch nut having a large stove pipe.

FIG. 5 illustrates features of a clinch nut that will generally leave too much fluid in the container after draining through the single opening of the clinch nut. The stove pipe in FIG. 5 has a height of about 20 mm, including a base region having a height of about 4.6 mm and a top region having a height of about 15.4 mm.

The use of a composite material including a polymeric layer has been found to provide benefits when connecting to a clinch nut, compared with the use of a monolithic metal material. For example, the container wall formed of the composite material may flow more easily for forming the joint (and forming a seal between the clinch nut and the composite material encircling the opening). As another example, the container wall formed of the composite material may have reduced residual stress in the region of the clinch nut, as compared to a monolithic material. Without being bound by theory, it is believed that the polymeric layer is capable of elastically and/or plastically deforming (and preferably also capable of relaxing), and this behavior improves the performance during and after joining with the clinch nut. For example, the polymeric layer may provide a bias that pushes the metallic layers in one or more directions (e.g., an outward direction) for enhancing the integrity of a seal.

Plug

The plug may be formed of any material that allows for repeated sealing of the drain hole and removal for draining of the oil. The material of the plug should be capable of sealing at operating temperatures and environment (e.g., heated oil) of the oil pan. The material of the drain plug may be selected so that the risk of damage from stripping of the threads of the plug and the clinch nut are reduced or eliminated.

The plug may be used to form a primary seal, and preferably forms both a primary and a secondary seal. The plug may have a threaded shaft for forming a seal (e.g., a primary seal) when inserted into the threaded opening of the clinch nut. The plug may have a flange portion for compressing an elastomeric seal (e.g., an elastomeric ring) against an outer wall of the container for forming a seal (e.g., a secondary seal).

The plug preferably includes a metallic material.

The plug may include one metal alloy. The plug may include a plurality of metal alloys. For example, the plug may have a layer structured. The layer structure may have a core layer of a first metal alloy and an outer layer of a different metal alloy.

The plug may include or be formed of a bi-metal including an outer layer and an inner layer. The outer layer preferably has a lower hardness than the inner layer. The difference in the hardness may be about 10 or more, about 20 or more, or about 30 or more HRB.

The outer layer may include a generally low hardness material (such as a zinc coating).

The plug may be engineered (e.g., designed and/or formed of selected materials) so that the plug is damaged prior to damaging the clinch nut and/or damaging the oil pan.

Flange

The plug component has a flange portion for creating a seal between the flange portion and an outer surface of the bottom of the oil pan. Preferably the seal is a secondary seal. The flange portion preferably is sufficiently large so that a seal is made outside a circumference of the clinch nut on the outer surface. For example, the flange portion should be sufficiently large to form a seal in the region of the container outside of the region affected by the clinch nut (e.g., outside of the attachment portion of the clinch nut). The plug component preferably includes a sealing ring formed of an elastomeric material. The sealing ring may be attached to the flange portion or may be removably located over the flange portion. The sealing ring may be characterized by an inner circumference and an outer circumference. Some or all of the inner circumference may contact oil which has escaped past the primary seal. Preferably, the outer circumference of the sealing ring contacts an atmosphere outside of the container assembly (e.g., oil pan assembly).

Figure 6A:
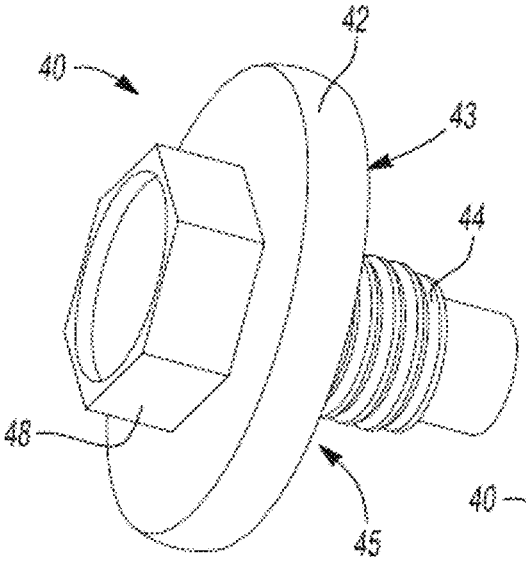
FIG. 6A is a perspective view of an illustrative drain plug with the head portion in the front.
Figure 6B:
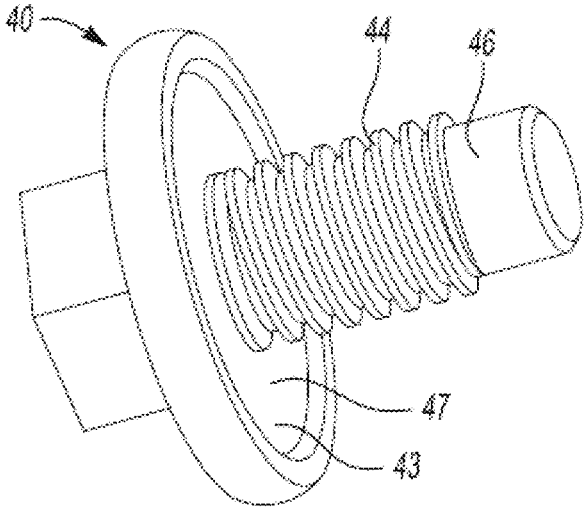
FIG. 6B is a perspective view of an illustrative drain plug with a shaft in the front.
Figure 6C:
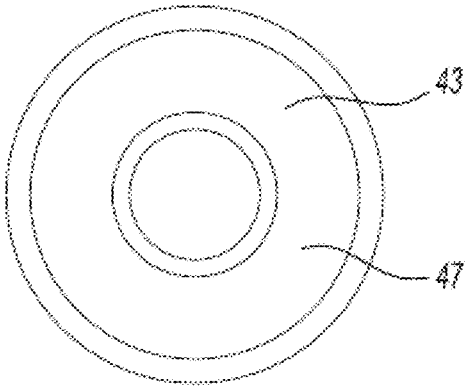
FIG. 6C is a view of the drain plug looking down the shaft.
Figure 6D:
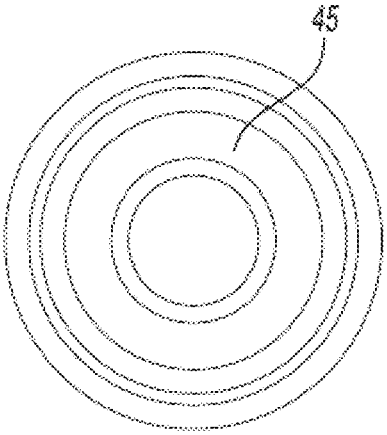
FIG. 6D is a view of the drain plug having an elastomeric seal, looking down the shaft.

The drain plug may include one or more of the features illustrated in FIGS. 6A, 6B, 6C, and 6D. The drain plug 40 typically includes a shaft portion having a flange portion 42 for sealing the drain opening. The flange portion 42 preferably has a flange surface 43 that is sufficiently large so that the flange surface can seal the drain opening with the bottom of the clinch nut covered by the flange portion 42. The sealing of the drain preferably employs an elastomeric seal (not shown) over the flange surface 43. The drain plug 40 has a shaft portion 46 including threadings 44 for threading into the internal threadings of the clinch nut 20. The flange surface 43, may be a recessed surface 47, such as illustrated in FIGS. 6B and 6C. The drain plug may include a seal or gasket (e.g., an elastomeric seal) 45, such as illustrated in FIG. 6D.

Figure 7:
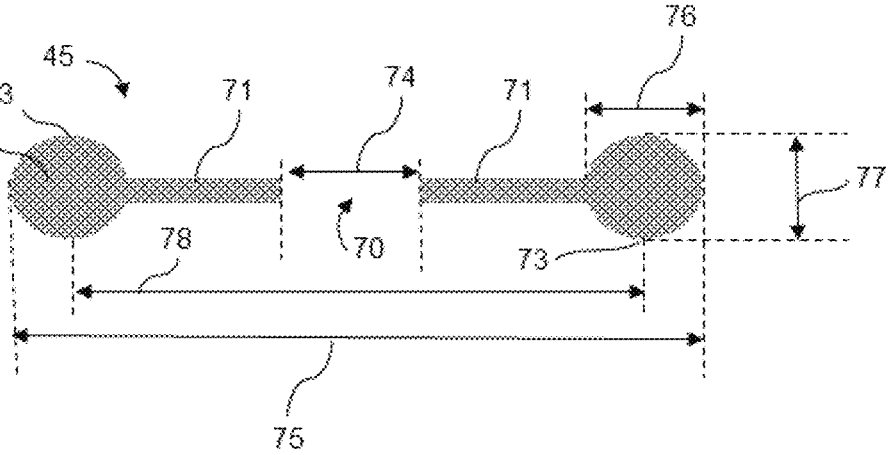
FIG. 7 is a cross-sectional view showing illustrative feature that may be employed in an elastomeric seal according to the teachings herein.
Figure 8:
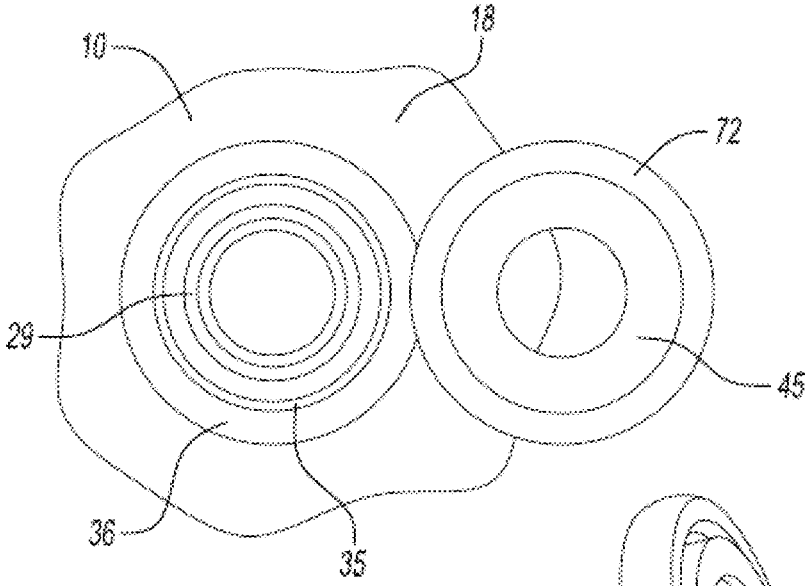
FIG. 8 is a photograph showing a seal positioned adjacent to an opening of a surface of a container.

The seal or gasket for the plug preferably provides a seal between an outside surface of the container and a surface of the plug (e.g., a flange surface of the plug). The seal may have an opening for fitting over the shaft of the plug. The opening may be characterized as an inside diameter of the seal, such as the seal 45 illustrated in FIG. 6D. The opening should be sufficiently small so that lateral movement of the seal is reduced or minimized when the seal is placed on the shaft. The seal preferably fits at least partially in a recessed surface of the flange of the plug. The seal preferably has a first portion adjacent to the opening of the seal that is connected to a second portion that is towards or adjacent to an outer diameter of the seal. The second portion preferably has a region that is thicker than the first portion. As such, the second portion may form the seal between the plug and the container. The second portion may have a cross-section that is generally curved. For example, the second portion may have a cross-section that is generally oval, generally elliptical, or generally circular. The first portion may function as a spacer to locate the second portion (the sealing portion) away from the region of the container where the clinch nut has been attached to the container wall. By locating the seal in this manner, it may be possible to form a more reliable seal without concern for any damage (e.g., deviation from a planar surface) that may have occurred near the connector portion of the clinch nut. A cross-section of an illustrative seal 45 is shown in FIG. 7. Sealing occurs when the sealing region/sealing surface 73 in the second portion 72 is compressed against between the container and the plug. The sealing may be characterized by a sealing distance or sealing diameter 78. The seal has an opening 70 which may be characterized by an inner diameter 74. The seal may be characterized by an outer diameter 75. The first portion 71 is connected to the second portion and may space the second portion (e.g., concentrically) around the opening 70. Preferably, the ratio of the outer diameter 75 to the inner diameter 74 is about 2.1 or more, more preferably about 2.3 or more, even more preferably about 2.5 or more, and most preferably about 2.7 or more. The second portion may be a sealing ridge including the sealing region 73. The second portion may have a length 76. The ratio of the sealing diameter 78 to the diameter of the shaft of the bolt preferably is about 1.8 or more, more preferably about 2.0 or more, and more preferably about 2.2 or more. The ratio of the inside diameter of the seal 74 to the diameter of the shaft of the plug preferably is about 0.95 or more, more preferably about 0.98 or more, even more preferably about 1.00 or more, and most preferably about 1.01 or more. The ratio of the inside diameter of the seal 74 to the diameter of the shaft of the plug preferably is about 1.3 or less, more preferably about 1.1 or less, and most preferably about 1.03 or less. The second portion preferably has a thickness 77 that is higher than a thickness of the first portion. Preferably, the first portion has a generally uniform thickness. Preferably, the ratio of the maximum thickness of the second portion to the average thickness of the first portion is about 1.1 or more, more preferably about 1.3 or more, and most preferably about 1.8 or more. It will be appreciated that positive positioning of the seal may be provided by the recess and or the seal may be adhered to the flange, so that the first portion of the seal is not required for positioning the seal. As such, some or all of the first portion may be eliminated. For example, the ratio of the inside diameter of the seal (i.e., the opening of the seal) to the diameter of the shaft may be greater than 1.1, greater than 1.3, greater than 1.5, or greater than 1.7. Relative features between the seal/gasket and the clinch nut/composite material that may be employed are illustrated in FIG. 8. For example, the openings of the container and the opening of the seal may be similar size (e.g., the diameter of the opening of the seal may be within 10%, within 5%, or within 2% of the opening of the container. As another example, the sealing region of the seal may encircle the opening of the container with the sealing region forming in the flat region 36. Preferably, the sealing region of the seal entirely avoids contacting the region of the composite material 35 that is affected by the clinch nut.

Figure 9A:
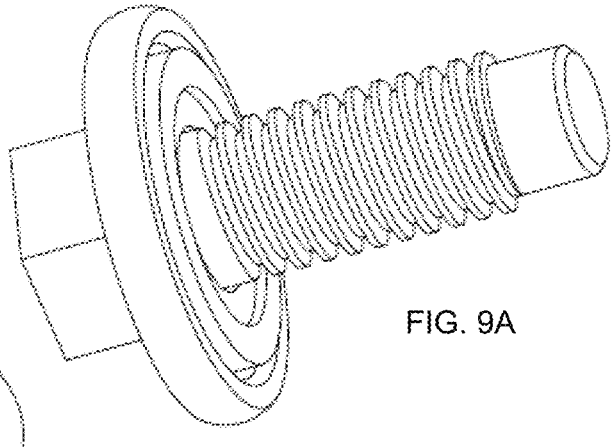
FIG. 9A is a perspective view of a bolt having a small flange surface and a seal having a small diameter.
Figure 9B:
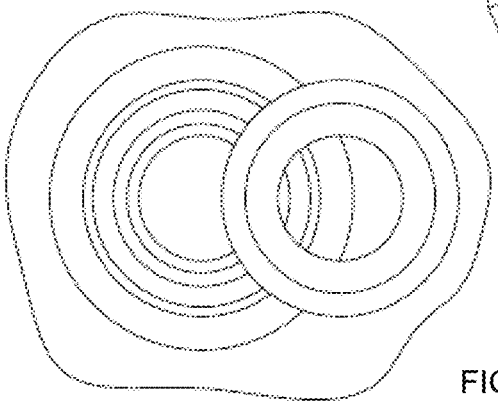
FIG. 9B shows the outer surface of a container having a clinch nut opening and a composite material with the seal of FIG. 9A positioned near the opening.

FIG. 9A shows a typical bolt with an elastomeric seal that sits in a recessed surface of the bolt. This bolt may be used for sealing a typical drain in a container. However, it has been found that this bolt may result in failures in a container including a clinch nut and laminate material according to the teachings herein. FIG. 9B is a bottom view (showing an outer surface of the container) of an aluminum laminate material having a clinch nut attached with a generally small seal positioned near the opening of the container. The surface of the laminate material in the region of the clinch nut generally is not flat and is not suitable for sealing. However, the seal sealing ridge of the seal will only contact this uneven region of the laminate and the seal may fail. When using a laminate material, the flange surface in FIG. 9A is found to be too small. The diameter of the sealing region is also too small.

Figure 10A:
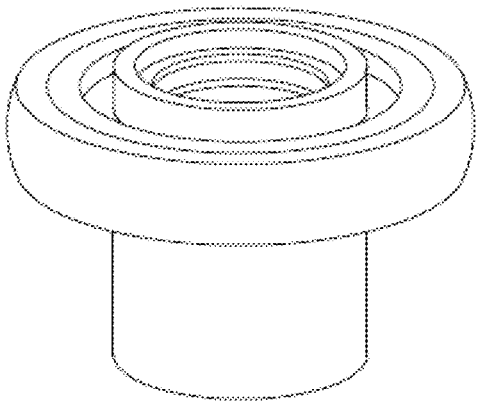
FIG. 10A is a perspective view of a clinch nut having a long smoke pipe.
Figure 10B:
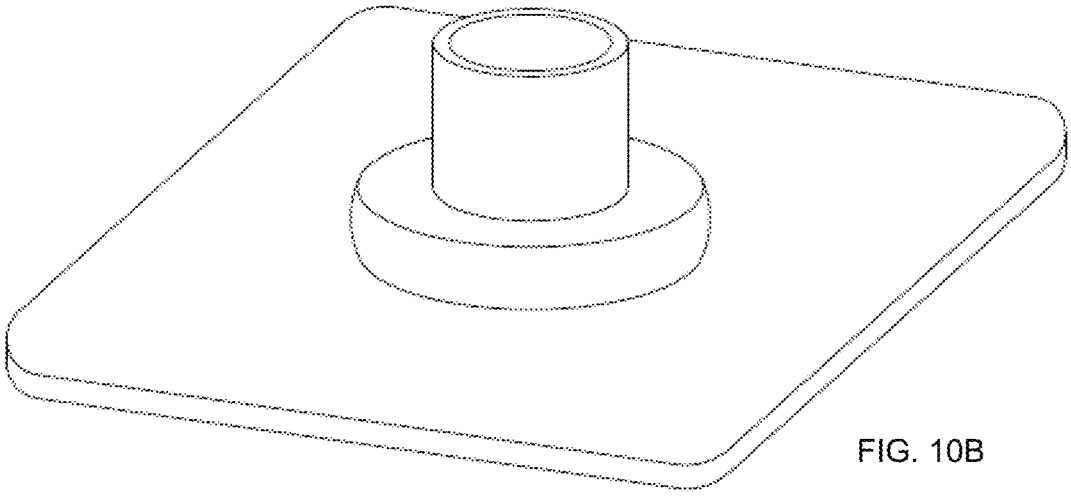
FIG. 10B is a perspective view of an oil pan assembly showing the clinch nut of FIG. 9A attached to a laminate material.
Figure 11:
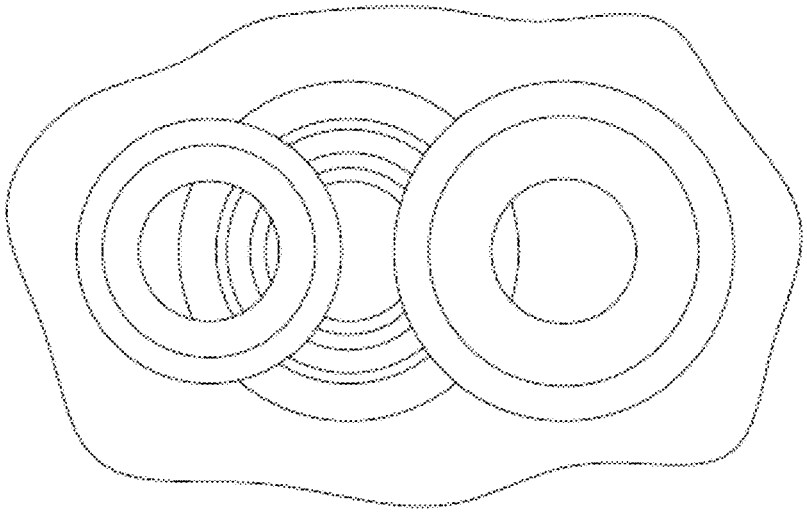
FIG. 11 shows an outer surface of a container with the seals of FIGS. 8 and 9B.

FIGS. 10A and 10B show a clinch nut having a stove pipe that is too long. This results in unacceptable quantities of fluid (e.g., oil) being left in the oil pan or other container after draining is complete. In FIG. 10B, the clinch nut is attached to the aluminum laminate material. In FIG. 10B, the interior surface of aluminum laminate material (i.e., facing a cavity of the container) is seen, and the extent to which the clinch nut extends into the cavity is undesirably long.

Figure 17:
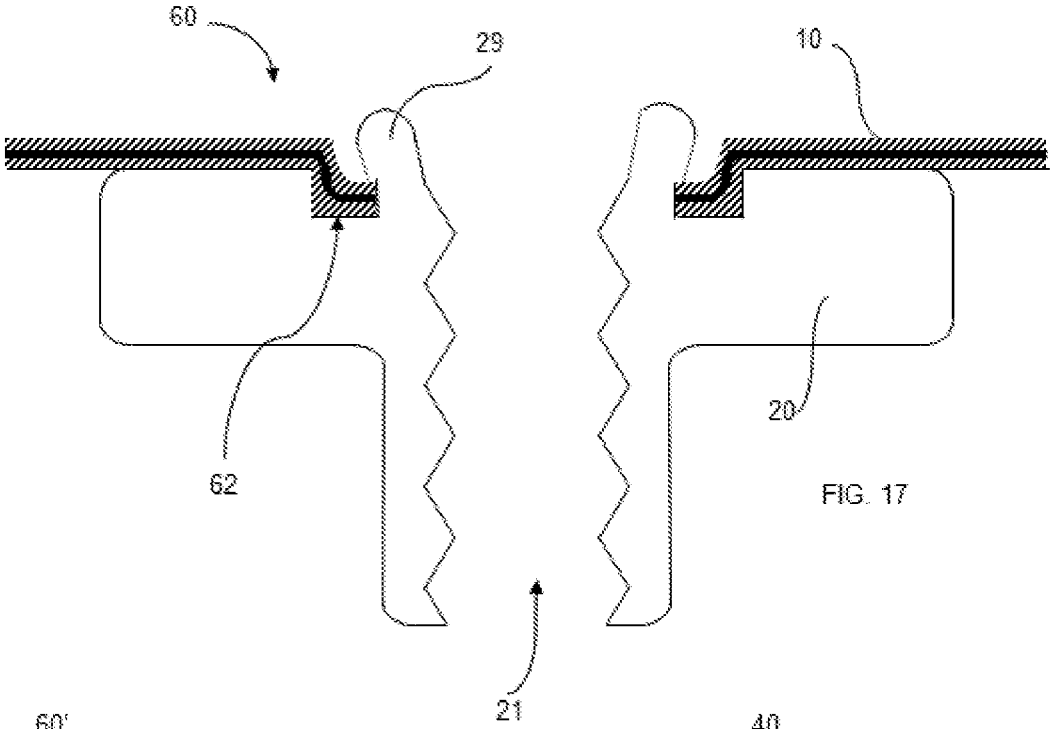
FIG. 17 is a cross-sectional view of a portion of an illustrative container assembly showing features that may be employed in a container assembly, such as a seal between a clinch nut and a laminate material. Preferably the seal is a mechanical seal. The seal may prevent leaking of fluid (e.g., liquid or gas, preferably a liquid) between the clinch nut and the laminate.

FIG. 17 is a cross-sectional view of an illustrative container assembly 60 showing a clinch nut 20 attached to a portion of a container wall formed of a composite material 10. The assembly has an opening including a passage 21 through the clinch nut 20. The container assembly 60 includes a seal 62 between the clinch nut 20 and the composite material 10. The seal is a liquid-tight seal and preferably is a gas-tight seal.

Figure 18:
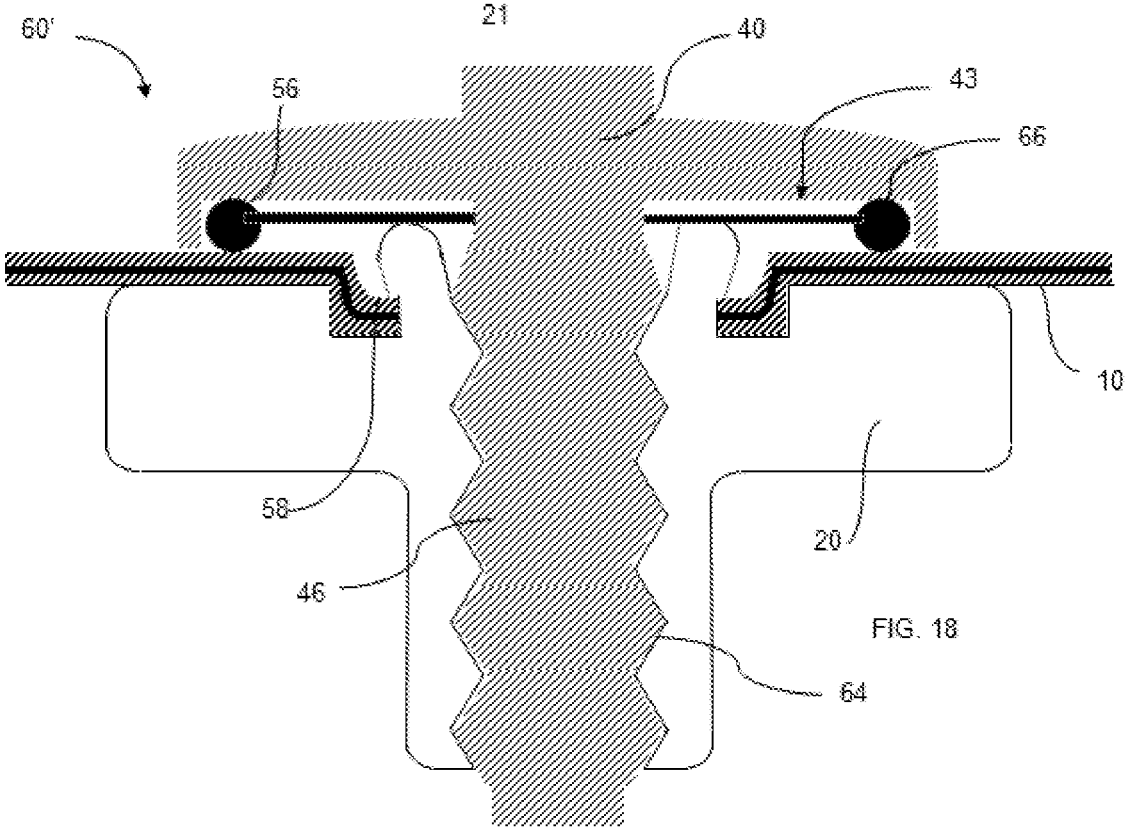
FIG. 18 is a cross-sectional view of an illustrative container assembly showing features that may be used in a container assembly according to the teachings herein. For example, the container assembly may be configured to form a seal along a threaded opening, such as by inserting a threaded shaft into the opening. As such, a seal may be formed between a drain plug and the clinch nut. As another example, the container may form a seal between a flange surface of a drain plug and the laminate material (e.g., using an elastomeric seal interposed between the two surfaces).
Figure 19:
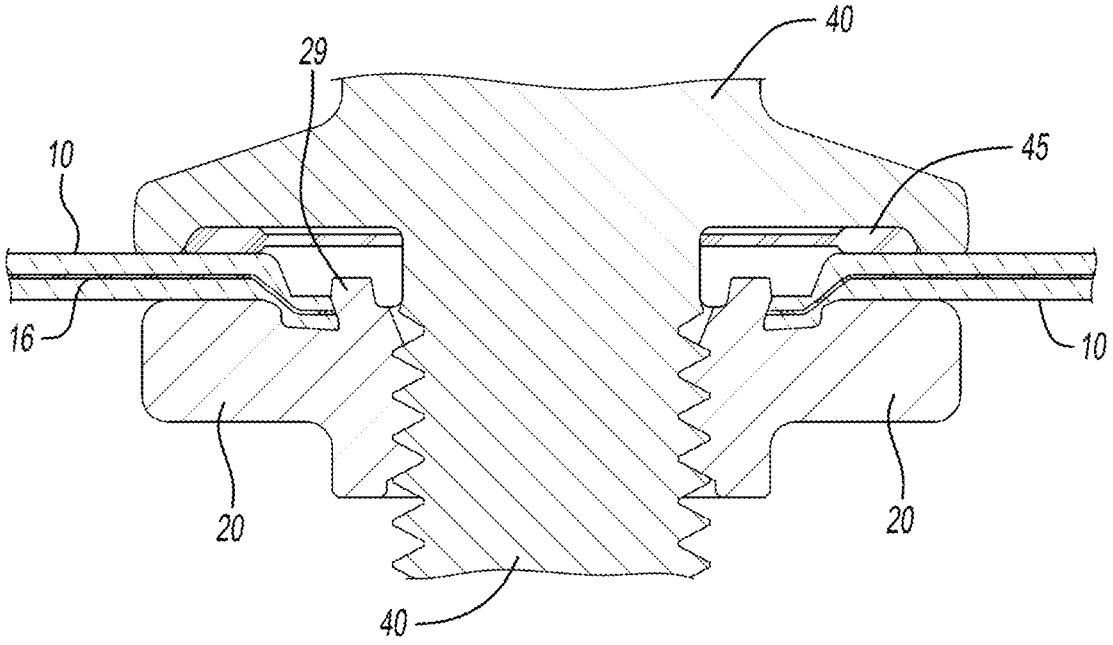
FIG. 19 is a photograph of an illustrative cross-section of a container assembly including a clinch nut and a laminate material.

FIG. 18 is a cross-sectional view of an illustrative container assembly 60' showing a clinch nut 20 attached to a portion of a container wall formed of a composite material 10, and a drain plug 40 having a flange surface 43 and a seal component 56. The seal component 56 preferably is positioned between the composite material 10 and the flange surface 43 in a region away from any uneven surface caused by the sealing of the clinch nut and the composite material. The container assembly 60' may include a seal 64 (e.g., a primary seal) between a shaft 46 of the drain plug 40 and the opening of the clinch nut 20. This seal preferably is liquid-tight and more preferably is gas-tight. The container assembly preferably includes an additional seal 66 where the elastomeric seal component 56 seals between the flange surface 43 of the drain plug and a surface of the composite material. This seal preferably is liquid-tight and more preferably is gas-tight.

The teachings herein are not limited to oil pan assemblies, but may be applied to other containers. The container may be employed for a fluid that is a gas or a liquid. Preferably the fluid is a liquid. The container may be isolated from the atmosphere or may have an opening to the atmosphere. The fluid (e.g., the liquid) preferably is at ambient temperature or at elevated temperatures (e.g., elevated over ambient temperature by about 40° C. or more, about 70° C. or more, or about 100° C. or more), and more preferably is exposed to cycles between ambient temperature and elevated temperatures. The fluid may experience a decrease in its viscosity (e.g., in units of poise) during an operational cycle (preferably a decrease in its viscosity of about 10% or more, about 30% or more, about 50% or more, or about 70% or more). The container may be employed for holding a food ingredient, water, an industrial liquid, or a vehicle fluid. The container may be used for an automotive fluid. The container may be used for holding a fluid during transport. The container may be used for a transmission fluid. The container may be used for a refrigerant. The container may be used for storing a reservoir of a reactant for a vehicle exhaust system. The container may be formed from a single material. In some applications the container may be formed from two or more different materials. For example, a container may be formed by attaching a first material (e.g., a stamped aluminum composite material) to a second material (e.g., a monolithic metal, preferably a monolithic aluminum). A preferred second material may be a material used for an engine block, such as an aluminum engine block. Although the teachings generally teach the use of aluminum (e.g., for the laminate/composite material), it will be appreciated that other metals may be substitute throughout, in the teachings herein and in the claims. For example, a metal for the container may be chosen to be compatible with the fluid (e.g., liquid) being held in the container and/or the thermal cycling of the container or the fluid.

If the container is formed by joining two or more different materials, it is preferred that the different materials have similar coefficients of linear thermal expansion (i.e., CLTE) in a temperature range of use (e.g., from about 0° C. to about 80° C., from about 0° C. to about 100° C., from about 0° C. to about 150° C., or from about −30° C. to about 180° C.). Preferably the ratio of the higher coefficient of linear thermal expansion to the lower coefficient of linear thermal expansion (of two materials having different CLTE) is about 10 or less, more preferably about 5 or less, even more preferably about 3 or less, and most preferably about 2 or less. For example, one material may be made of a monolithic metal and the other material may be a laminate including one or more metal layers, wherein at least one (and preferably all) of the metal layers are of the same metal (e.g., same class of metal, or same grade of metal) as the monolithic metal. It is contemplated that one or more walls of the container may include a non-laminate material.

Hardness may be measured using Rockwell Hardness (e.g., A, B, C, D, or E scale). For example, RHC refers to Rockwell hardness C scale using a load of 150 kgf and an indenter that is a 120° diamond having a spheroconical shape. RHB refers to Rockwell hardness B scale, measured using a load of about 10 kgf and an indenter that is a 1/16 inch diameter steel sphere.

Hard steel is typically characterized by a hardness of 55-66 HRC or even higher.

Stainless steel 304 L typically has a hardness of 25-32 HRC (e.g., about 70 HRB)

Aluminum 6061-T6; 6061-T651 typically has a hardness of about 60 HRB.

Strong aluminum alloys typically have a hardness greater than about 65 HRB. For example, Aluminum 2024-T3 has a hardness of about 75 HRB. Aluminum alloys having a hardness of about 87 or more HRB (075 aluminum) may also be used.

Cast aluminum oil pans are typically made by a process that results pores and/or inclusions that result in localized weakness. Thus, there is a risk of failure if a weak area is near the drain area.

In contrast, the present invention preferably includes rolled aluminum sheets and thus avoids localized weaknesses due to pores and/or inclusions.

The clinch nut may be formed of a material that is the same material as the plug, or may be formed of a different material (e.g., a different type of metal or a different grade of metal).As used herein metals that are of different types may have different primary metal element (i.e. a metal element present at the highest concentration in atomic percent), wherein metals that are different grades may have primary metals that are the same.

In the various aspects of the teachings herein, the clinch nut or the plug (and more preferably both the clinch nut and the plug) use a steel, and more preferably a coated steel. The coated steel may be coated with a metal or metal alloy having a lower hardness than the steel substrate. The coating may be a zinc-containing coating, including, consisting essentially of, or consisting entirely of zinc. For example, the zinc-containing coating may be a zinc alloy (or mixture) include about 30 atomic percent or more zinc, about 60 atomic percent or more zinc, or about 80 atomic percent or more zinc. By way of example, the zinc-containing coating may include aluminum, magnesium, or both.

Preferably, the clinch nut brings both of the aluminum layers of the laminate material into the strength of the joint, so that the joint can match the joint strength of monolithic aluminum of equivalent total gage thickness (for example with respect to torque strength).

Preferably the clinch nut and/or the drain plug are formed of a relatively hard material with a covering of a relatively soft material. For example, by employing a hard material, it may be possible to reduce the height of the stove pipe (i.e., by reducing the number of turns of threading). By using a soft cover material, it may be possible to reduce or eliminate the chance of over-torqueing the seal and stripping the threads. By way of example, the clinch nut and/or the drain plug may include a steel material or other material harder than steel with a covering of a zinc-containing coating or other material that is as soft as, or softer than zinc. The clinch nut and the drain plug may be formed of different grades of steel (which each may be free of coating or may include a coating, such as a zinc-containing coating according to the teachings herein). Preferably, the different grades of steel are selected so that the drain plug will fail (e.g., break, have threadings strip, or otherwise fail) before stripping the threading of the clinch nut.

Preferably, the surface of the clinch nut (e.g., the interior threaded surface) has a hardness greater than the hardness of the surface of the drain plug (e.g., the exterior threaded surface), more preferably the difference in hardness is about 1 or more, even more preferably about 1.5 or more, and most preferably about 2.0 or more, on the Mohr hardness scale.

General Information Applicable to the Teachings

It is to be understood that the disclosed embodiments are merely exemplary of the teachings that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present teachings.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

Any numerical values recited herein include all values from the lower value to the upper value in increments of one unit provided that there is a separation of at least 2 units between any lower value and any higher value. As an example, if it is stated that the amount of a component or variable is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight, and vice versa. Thus, an expression in the Detailed Description of the Invention of a range in terms of at "'x' parts by weight of the resulting composition" also contemplates a teaching of ranges of same recited amount of "x" in percent by weight of the resulting composition. Relative proportions derivable by comparing relative parts or percentages are also within the teachings, even if not expressly recited.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of, or even consisting of, the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

Relative positional relationships of elements depicted in the drawings are part of the teachings herein, even if not verbally described. Further, geometries shown in the drawings (though not intended to be limiting) are also within the scope of the teachings, even if not verbally described.

EXAMPLE

Noise, vibration, harshness (NVH) analysis is performed on oil pans made with different materials. In Example 1, the walls of the oil pan are formed from an aluminum composite material. The aluminum composite material includes two sheets of aluminum, each having a thickness of about 0.79 mm, and a polymeric core layer having a thickness of about 0.025 mm sandwiched between the two aluminum sheets. The thickness of the aluminum composite material is about 1.6 mm and the mass of the oil pan is about 0.509 kg. In Comparative Example 1, the walls of the oil pan are formed from a monolithic aluminum. The thickness of the aluminum composite material is about 1.6 mm and the mass of the oil pan is about 0.509 kg.

Figure 12:
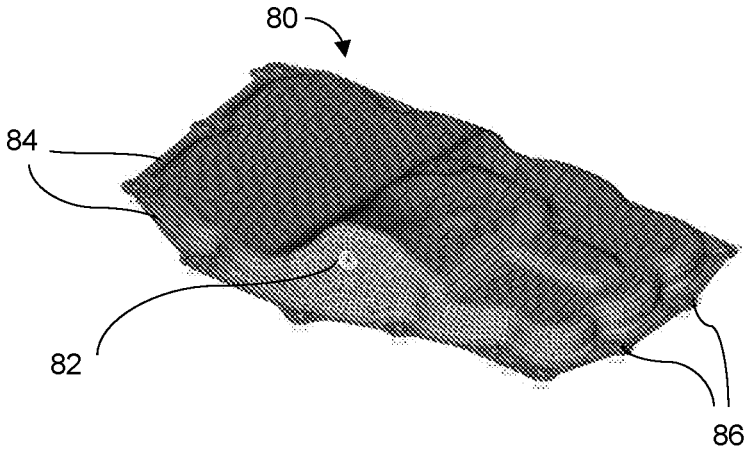
FIG. 12 is an illustrative models of an oil pan/container for finite elemental analysis of NVH properties.

The structure of the oil pan employed in the NVH analysis is shown in FIG. 12. The structure 80 includes a drain hole 82 and flanges 84 with mounting holes 86 (e.g., for attaching to an engine block. The structure may be attached with a plurality of bolts. The structure may be sealed with a gasket or a sealant, such as an RTV sealant. The composite material preferably is sufficiently formable so that the structure can be formed by stamping a sheet of the composite material. The clinch nut preferably is attached to the structure before attaching the structure to another component for forming a cavity (e.g., before attaching to an engine block). The clinch nut preferably is attached to the structure after stamping the material to form the structure. The flanges 84 preferably extend along the entire perimeter of the structure. The NVH is analyzed using the following model parameters. For the structural model of the oil pan, the element size is 4 mm for the aluminum and the aluminum composite material. The element size is 4 mm for the oil pan formed from the glass nylon composition with an element size of 3 mm for smaller features. The model constrains all degrees of freedom at the bolt hole locations. In one analysis, the model employs parameters similar to those observed on a shaker table with force control. Here, the model enforces a unit normal velocity of 1 mm/s at bolt hole centers. Here, configurations with different masses will have similar response at low frequency. The model uses a light coupling assumption (e.g., mass and stiffness of block dominate boundary responses). The model evaluates the performance over a band width of the frequency from 100 Hz to 5000 Hz.

The acoustical analysis uses an acoustical model with an 11 mm target element size. The acoustic model excludes the mounting flange from the acoustic mesh.

The modeling employs a boundary element method (BEM). Here, the applied structural velocities are used as the boundary conditions for the acoustic mesh. Both sides of the front cover radiate noise. The modeling calculates the averaged normal velocity, the radiated sound power.

Figure 13A:
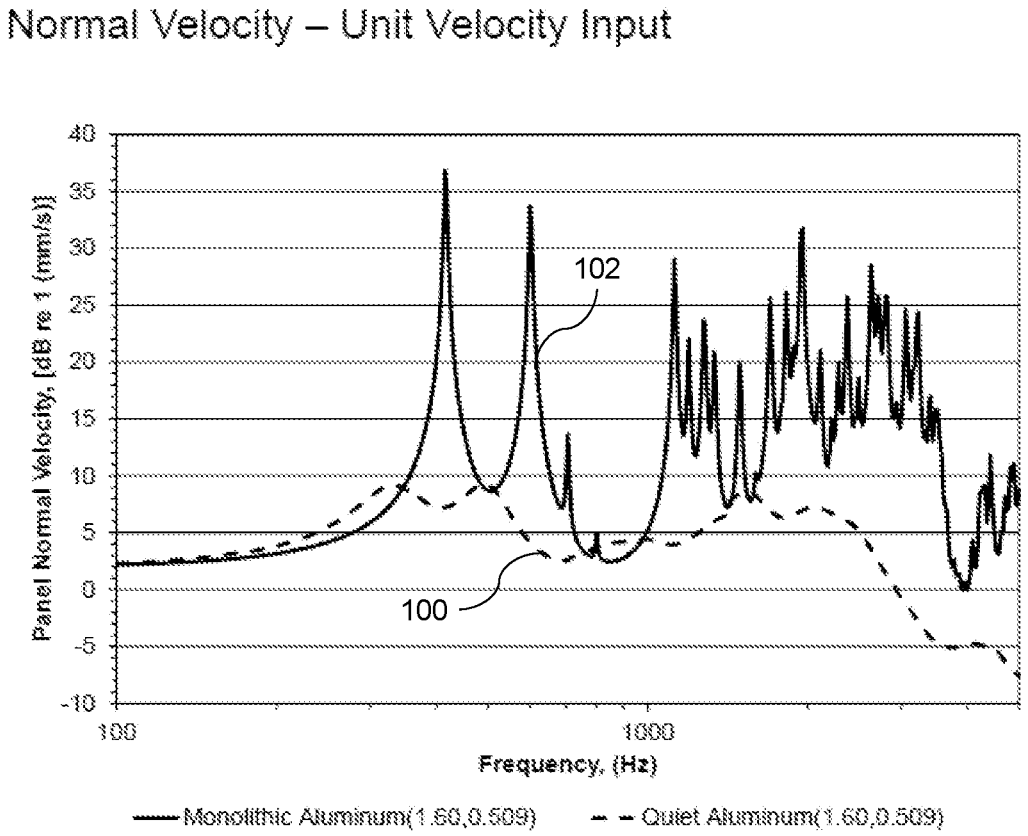
FIGS. 13A and 13B show illustrative NVH properties based on unit acceleration control.
Figure 13B:
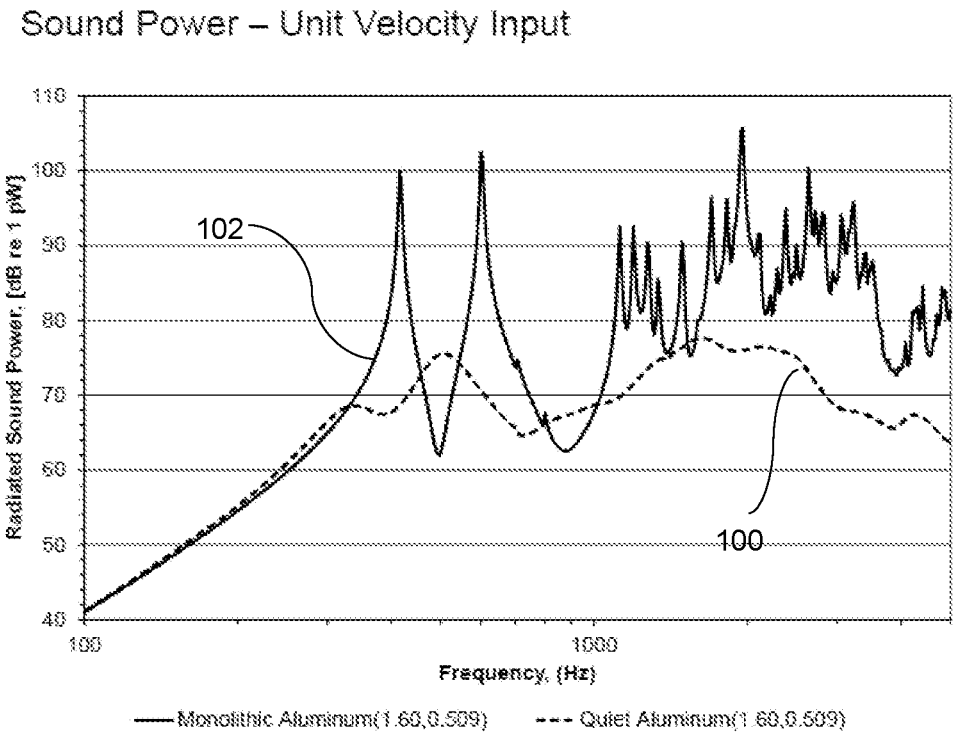
Figure 14:
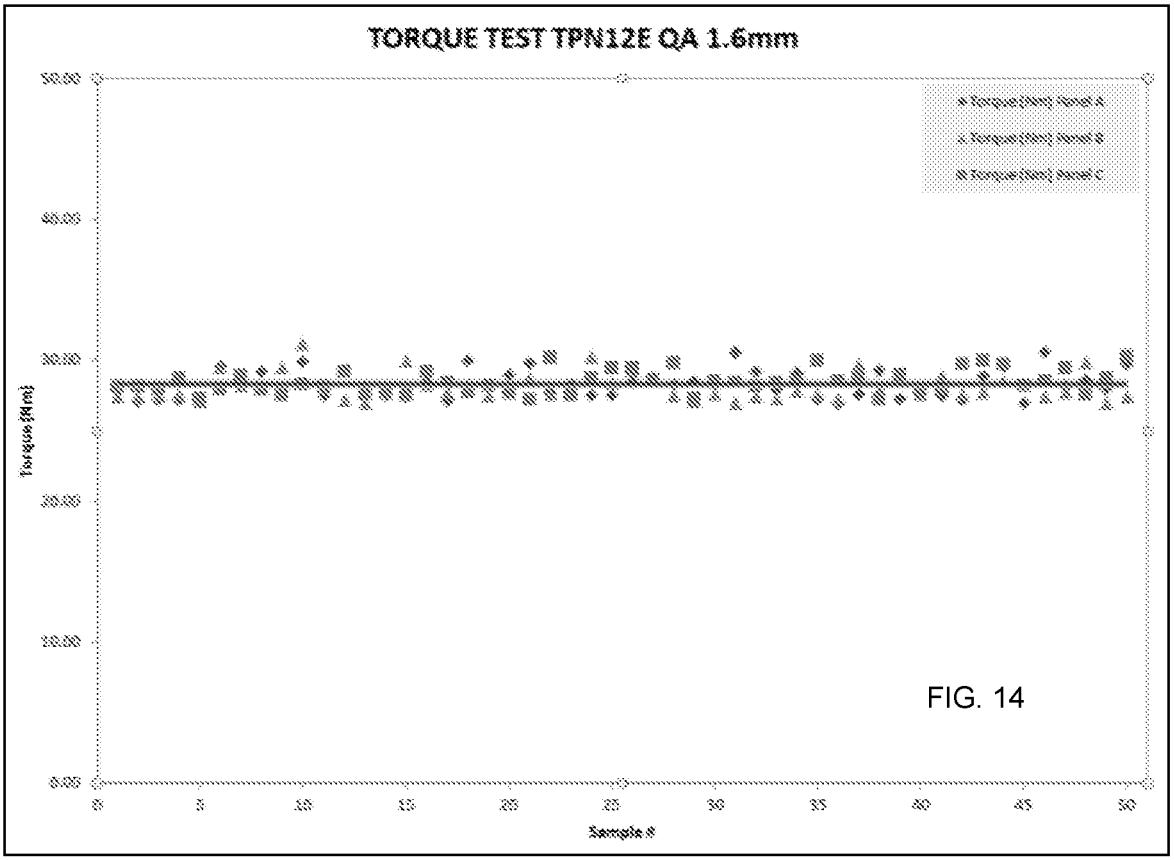
FIG. 14 shows illustrative torque test results for a clinch nut attached to a laminate material.
Figure 15:
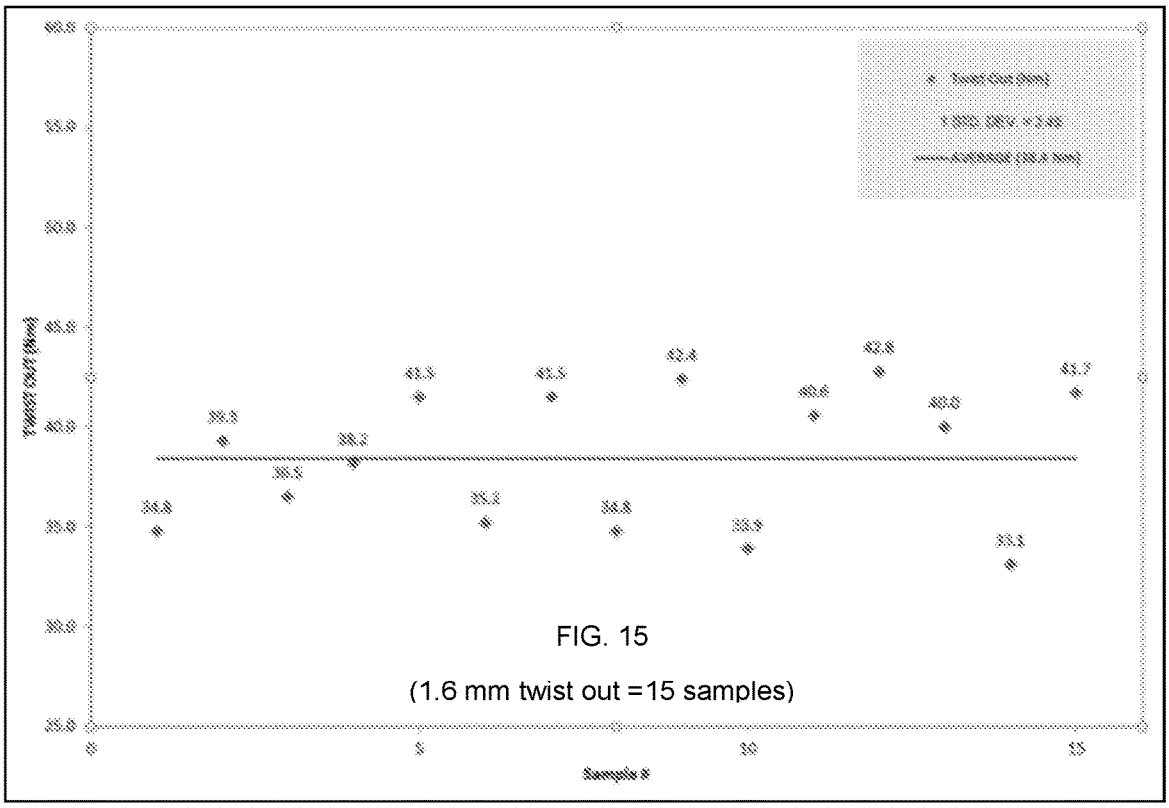
FIG. 15 shows illustrative twist-out test results for a clinch nut attached to a laminate material.
Figure 16:
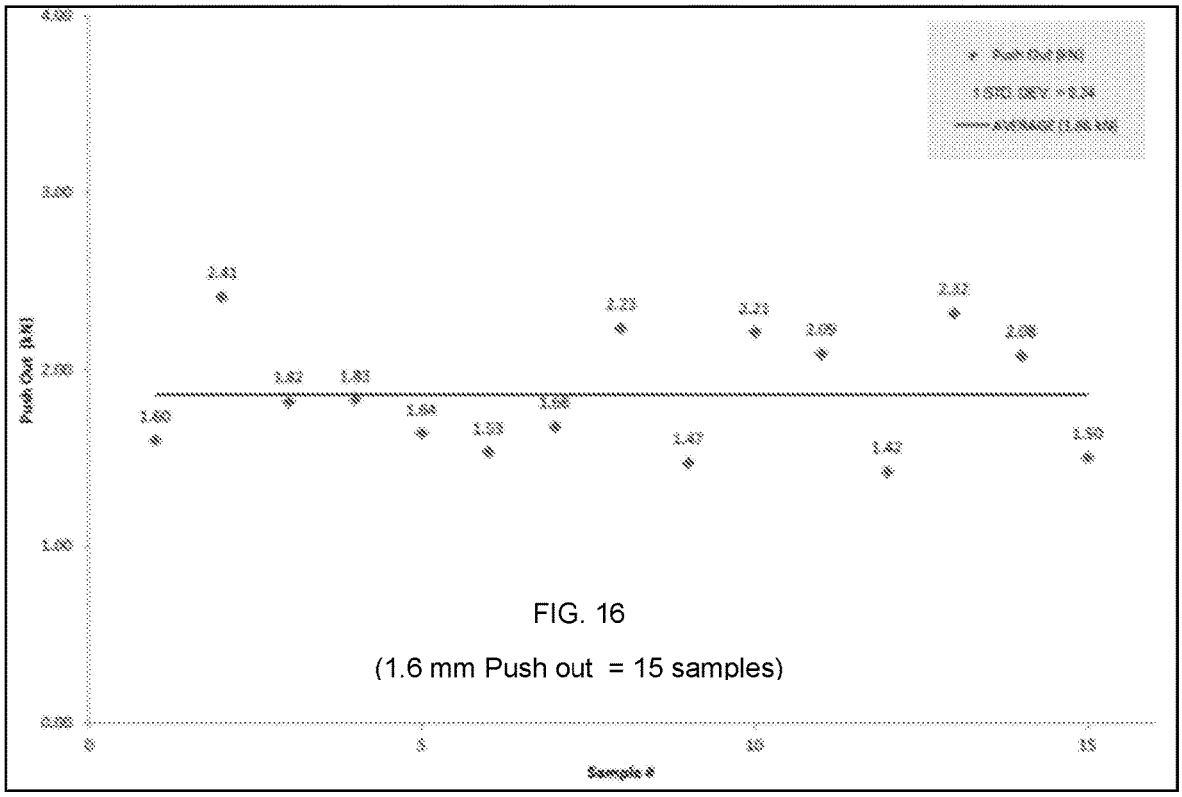
FIG. 16 shows illustrative push-out test results for a clinch nut attached to a laminate material.

The results of the modeling when using the unit acceleration control (i.e., similar to a shaker table with velocity control) are shown in FIG. 13A for the average normal velocity and FIG. 13B for the radiated sound power. In FIG. 13A and FIG. 13B, the benefits of using the aluminum composite material (Quiet Aluminum) are seen throughout the frequency spectrum. The aluminum composite material is particularly effective at damping the peaks, as compared to the comparative example.

Example 2 is prepared by attaching the aluminum composite material of Example 1 to a clinch nut, the test specimens have dimensions of about 76.2 mm×76.2 mm. The clinch nut has a base portion with a diameter of about 30 mm and an upper portion having a diameter of about 16 mm. The opening of the clinch nut is about 12.7 mm in diameter. The clinch nut has M12×1.75 threading. After attaching the clinch nut to the aluminum composite material, the specimens are tested for torque resistance, push-out resistance and twist-out resistance.

Torque Resistance Test

The torque resistance is the maximum torque that can be applied to the head of a drain plug in the clinch nut before failure of the test specimen. The torque resistance is measured on 50 specimens. The average torque resistance is 27 Nm and the standard deviation is 3 Nm.

Push-Out Test

The force required to push out the clinch nut from the oil pan bottom is measured on 15 specimens. The average push-out resistance is about 1.86 kN with a standard deviation of about 0.34 k N.

Twist-Out Test

The twist-out resistance is measured by torqueing the base portion of the clinch nut until failure of the attachment is observed. The test is repeated on 15 specimens. The average twist-out resistance is about 38.4 Nm and the standard deviation is about 3.4 Nm.

Example 2 meets the needs for torque resistance, push-out resistance, and twist-out resistance.

Comparative Example 3 is prepared similar to Example 2, except a steel nut is attached using projection welding. The steel nut does not form a joint with the aluminum composite material.

Comparative Example 4 is prepared similar to Comparative Example 3, except the aluminum composite material is replaced by a steel composite material including steel sheets instead of aluminum sheets. Comparative Example 4 fails the torque resistance test because the nut only welds to one of the steel layers of the steel composite material.

Comparative Example 5 is prepared similar to Example 2, except the aluminum composite material is replaced by a cast aluminum material. The standard deviation of the torque test is increased and some failures occur due to local weaknesses in the cast aluminum.

REFERENCE NUMBERS

10 Composite material/laminate material
12 First metallic layer
14 Second metallic layer
16 Polymeric layer
17 Inner surface of laminate material
18 Outer surface of laminate material
20 Clinch nut
21 Passage through the clinch nut
22 Bottom rim of opening
24 Upper rim of opening
26 Stove pipe portion
27 Top region of stove pipe
28 Base region of stove pipe
29 Extension member
30 Connector portion
32 Internal threadings

34 Height at the top of the clinch nut relative to the inner surface of the oil pan

35 Region of laminate affected by clinch nut

36 Flat region of the laminate encircling the area affected by the clinch nut

38 Circumference around the opening

40 Drain plug/Bolt

42 Flange portion

43 Flange surface

44 Threadings

45 Seal (e.g., elastomeric seal)

46 Shaft

47 Recessed Surface

48 Head portion

52 First portion of clinch nut (e.g., for providing a strong connection with the container.

54 Second portion of clinch nut (e.g., for providing additional length for threadings for receiving a drain plug).

56 Seal (e.g., elastomeric seal)

58 Uneven surface (e.g., due to the clinch nut/composite material seal)

60 Container assembly including a clinch nut and a laminate

62 Seal between clinch nut and the composite material

64 Seal between the clinch nut and the drain plug

66 Seal between the drain plug and the composite material

70 Opening in elastomeric seal

71 First portion of the seal (e.g., for spacing the sealing region from the plug).

72 Second portion of the seal (preferably including a sealing ridge for sealing the components)

73 Sealing region/sealing surface of the second portion

74 Size of opening (e.g., inside diameter of the seal)

75 Outside dimension (e.g. outside diameter) of the seal

76 Length of the second portion (e.g., diameter of sealing bead)

77 Thickness of second portion.

78 Sealing distance (e.g., diameter formed by the sealing region).

80 Structure for oil pan/container

82 Drain hole

84 Flange

86 Holes

100 Oil Pan formed of Aluminum Composite Material (Example 1)

102 Oil Pan formed of Monolithic Aluminum (Comparative Example 1)

What is claimed is:

1. A container assembly comprising:

i) a container having a cavity for holding a fluid and including a bottom portion, wherein the bottom portion includes a laminate material including a first aluminum sheet having a surface facing the cavity of the container, a second aluminum sheet having a surface facing an outside of the container, and a polymeric layer interposed between the first and second metal sheets;

ii) an opening in the bottom portion extending through the first and second aluminum sheets for draining the fluid from the container;

iii) a clinch nut attached to at least one of the first and second aluminum sheets extending only into the cavity, and being configured for receiving a drain plug that seals the opening and provides a primary seal to prevent flow of the fluid;

iv) the drain plug, wherein the drain plug has a threaded shaft for sealing the opening and a flange surface; and v) an elastomeric seal contacting the flange surface of the drain plug and the outside surface of the second aluminum sheet;

wherein the container assembly is an oil pan assembly;

wherein the elastomeric seal includes a sealing portion and a spacer portion connected to the sealing portion, wherein the spacer portion spaces and positions the sealing portion away from a region under the clinch nut.

2. The container assembly of claim 1, wherein the clinch nut is attached to both the first and second aluminum sheets.

3. The container assembly of claim 2, wherein a ratio of a thickness of the first aluminum sheet to a thickness of the second aluminum sheet is from about 0.33 to about 3.

4. The container assembly of claim 3, wherein the polymeric layer has a thickness of about 0.001 mm to about 0.2 mm.

5. The container assembly of claim 1, wherein the polymeric layer has a thickness that is about 15% or less of a total thickness of the laminate material.

6. The container assembly of claim 5, wherein the first and second aluminum sheets have a combined thickness of about 0.5 mm or more to about 4 mm or less.

7. The container assembly of claim 1, wherein the clinch nut is an aluminum clinch nut.

8. The container assembly of claim 1, wherein the clinch nut has a passage with internal threading and includes 3 or more turns of the threading.

9. The container assembly of claim 1, wherein the clinch nut includes a first portion that is a stove pipe portion and extends into the cavity.

10. The container assembly of claim 9, wherein the first portion has a height of about 15 mm or less as measured in a vertical direction from a top surface of the laminate to a top edge of the first portion.

11. The container assembly of claim 1, wherein the laminate has a stamped configuration.

12. The container assembly of claim 1, wherein the drain plug includes:

a threaded shaft for screwing into the clinch nut;

a head portion configured for receiving a tightening tool;

an elastomeric washer in contact with a flange portion of the drain plug and positioned so that the flange portion applies a force to the elastomeric washer for forming a seal between the flange portion and an outside surface of the bottom of the container.

13. The container assembly of claim 12, wherein the flange portion has a diameter of about 10 mm or more.

14. The container assembly of claim 12 wherein i) a ratio of a diameter of the elastomeric washer to a diameter of the shaft of the drain plug is about 2 or more; and/or ii) a ratio of a diameter of the flange of the drain plug to a diameter of the shaft of the drain plug is about 2 or more.

15. The container assembly of claim 1, wherein the clinch nut includes a coated steel.

16. The container assembly of claim 1, wherein the container assembly includes a coated steel drain plug.

17. The container assembly of claim 1, wherein a shaft of the drain plug and/or the stove pipe of the clinch nut is formed of a mixed metal.

18. A container assembly comprising:

i) a container having a cavity for holding a fluid and including a bottom portion, wherein the bottom portion includes a laminate material including a first aluminum sheet having a surface facing the cavity of the container, a second aluminum sheet having a surface facing an outside of the container, and a polymeric layer interposed between the first and second metal sheets;

ii) an opening in the bottom portion extending through the first and second aluminum sheets for draining the fluid from the container;

iii) a clinch nut attached to at least one of the first and second aluminum sheets extending only into the cavity, and being configured for receiving a drain plug that seals the opening and provides a primary seal to prevent flow of the fluid;

iv) the drain plug, wherein the drain plug has a threaded shaft for sealing the opening and a flange surface; and v) an elastomeric seal contacting the flange surface of the drain plug and the outside surface of the second aluminum sheet;

wherein the container assembly is an oil pan assembly;

wherein an attachment of the clinch nut to the first aluminum sheet forms a seal around an entire circumference of the opening, and the elastomeric seal forms a seal away from an area affected by the clinch nut.

19. The container assembly of claim 18, wherein the elastomeric seal includes a sealing portion and a spacer portion connected to the sealing portion, wherein the spacer portion spaces and positions the sealing portion away from a region under the clinch nut.

20. The container assembly of claim 19, wherein the elastomeric seal of the drain plug forms a secondary seal entirely outside of the affected area of the clinch nut, wherein the secondary seal contacts the aluminum outer surface of the container only at a flat area.

* * * * *